United States Patent [19]

Anderson

[11] 4,154,037

[45] May 15, 1979

[54] POLE SUPPORT ASSEMBLY

[76] Inventor: Frohman C. Anderson, 3435 Sharps Lot Rd., Swansea, Mass. 02777

[21] Appl. No.: 779,004

[22] Filed: Mar. 18, 1977

[51] Int. Cl.[2] ..... E02D 27/00

[52] U.S. Cl. ..... 52/296; 52/98; 52/298

[58] Field of Search ..... 52/98, 99, 295, 296, 52/297, 298, 221, 204, 728, 731; 220/241; 248/158; 138/142, 143, 153, 140, 109

[56] References Cited

U.S. PATENT DOCUMENTS

| | | | |
|---|---|---|---|
| 610,262 | 9/1898 | Dikeman | 138/109 |
| 913,376 | 2/1909 | Gherky | 138/143 X |
| 1,499,445 | 7/1924 | Clay | 52/98 |
| 1,574,563 | 2/1926 | Duff | 52/731 |
| 2,824,342 | 2/1958 | Hoyle, Jr. | 52/731 X |
| 3,198,296 | 8/1965 | Pfaff, Jr. et al. | 52/296 X |
| 3,257,765 | 6/1966 | Anderson et al. | 52/298 |
| 3,321,160 | 5/1967 | Turnbull | 52/296 X |
| 3,343,322 | 9/1967 | Lurkis et al. | 52/298 |
| 3,544,110 | 12/1970 | Dickinson | 52/297 X |
| 3,552,073 | 1/1971 | Millerbernd | 52/98 |

OTHER PUBLICATIONS

Millerbernd–Base Styles & Details (advertising flyer).

Kaiser Aluminum–Aluminum Lighting Standards, Jan. 15, 1971 (advertising flyer).

*Primary Examiner*—Price C. Faw, Jr.
*Assistant Examiner*—Carl D. Friedman
*Attorney, Agent, or Firm*—Lowe, King, Price & Becker

[57] ABSTRACT

A roadway pole carrying an overhead luminarie or the like is mounted on a support comprising a stationary, hollow base member anchored to the roadway with hardware located within the base. The lower end of the pole is secured to the base by an upstanding collar, and the interior wall of the pole adjacent the collar is reinforced with a pair of sleeve members. Access to the mounting hardware is provided by an opening formed in the sidewall of the base. The opening is sealed by an access door that requires a special tool for its removal. In a break-away version of the support, the collar is secured to a wedge-shaped, break-away coupling. The coupling in turn is mounted in a seat formed on the stationary base member. The wedge-shaped coupling and seat constitute a locking angle and are held together by friction. An optional shear pin may be provided across the coupling-base interface to more securely seat the coupling. However, the coupling separates from the base when the pole is struck by a moving vehicle thereby minimizing bodily injury and property damage.

36 Claims, 22 Drawing Figures

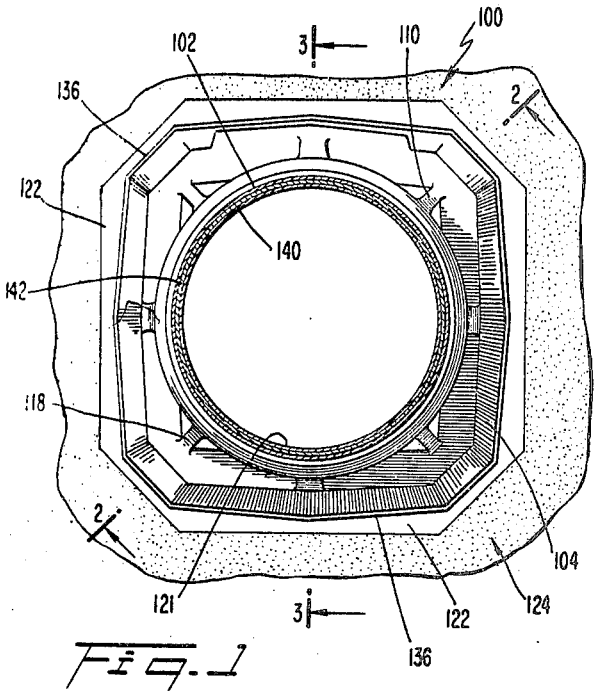
Fig. 1
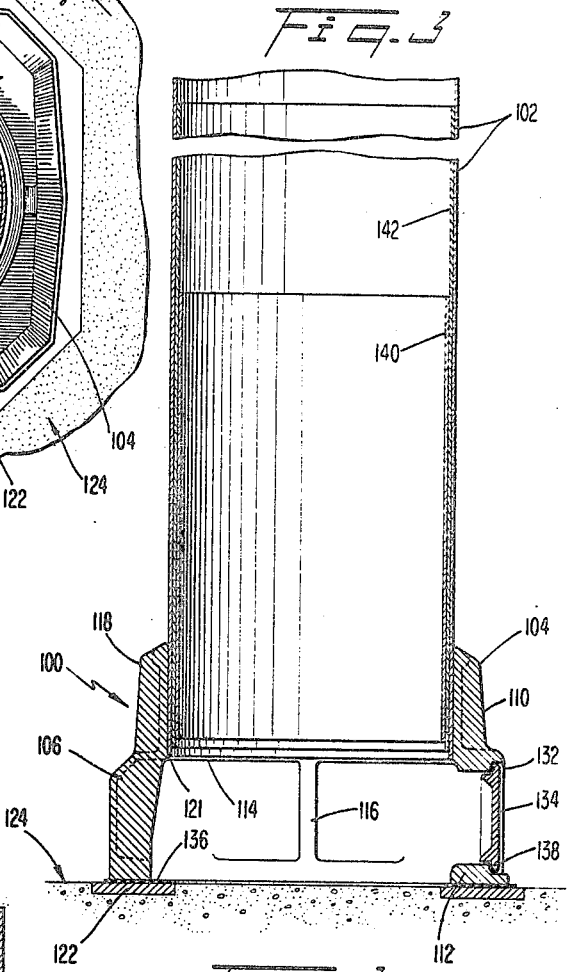
Fig. 3
Fig. 2
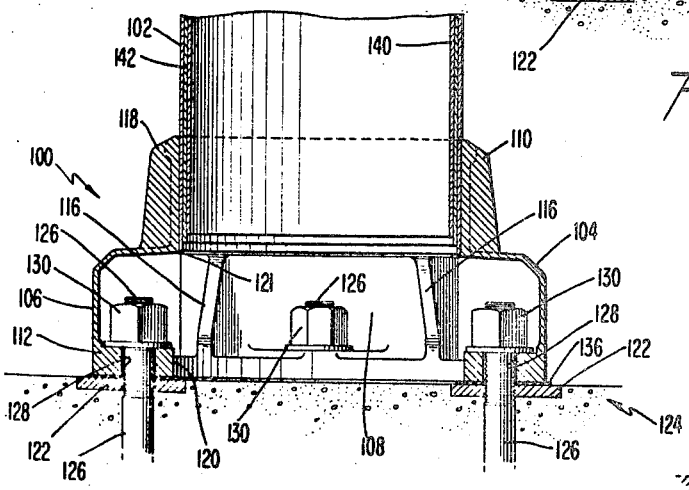
Fig. 11
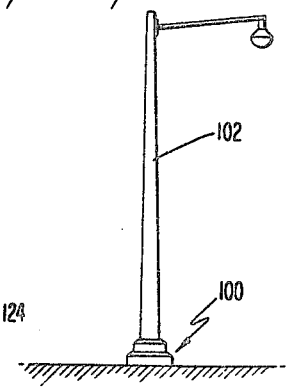

Fig. 10
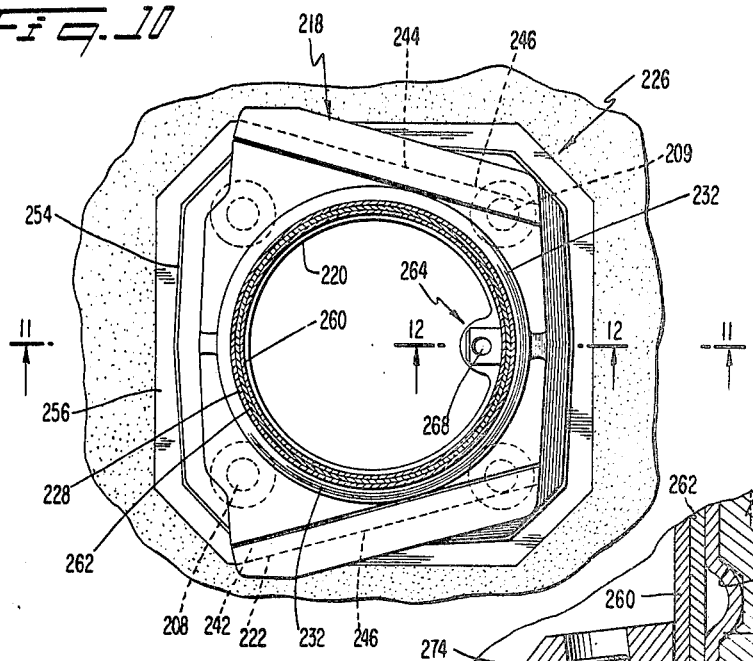
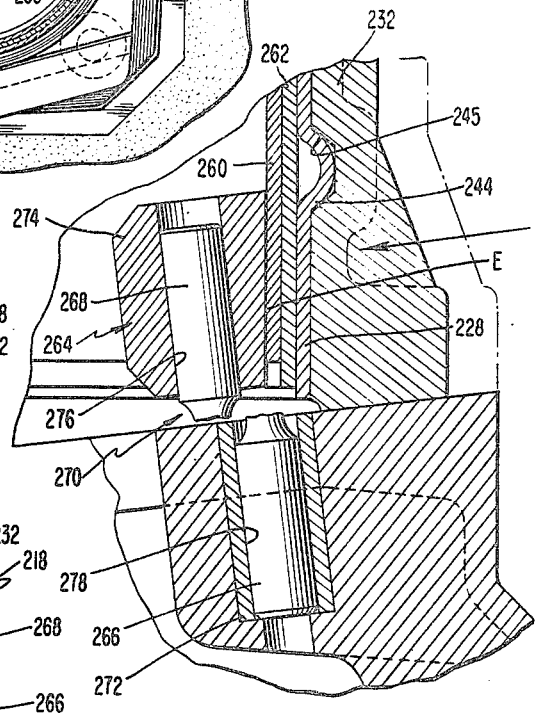
Fig. 12
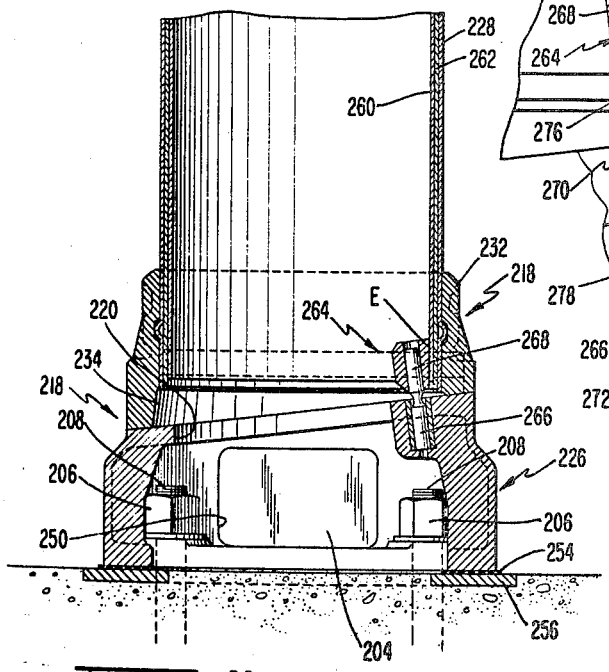
Fig. 11

Fig. 13
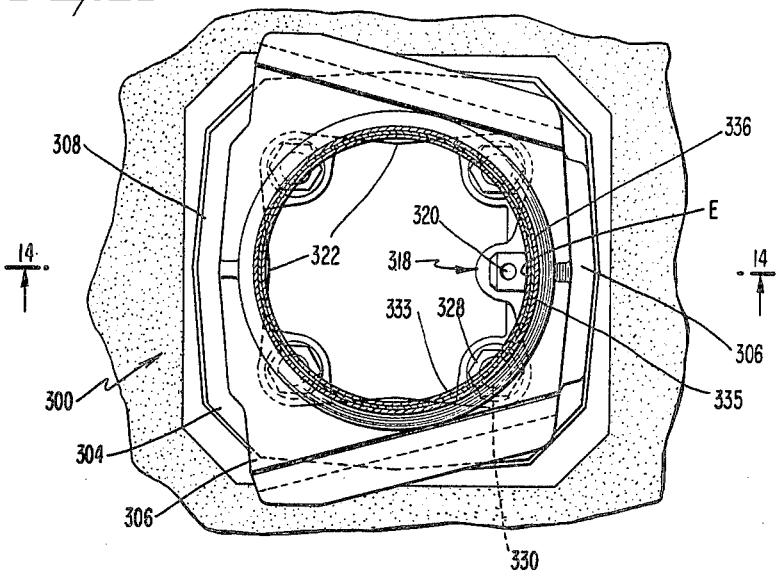
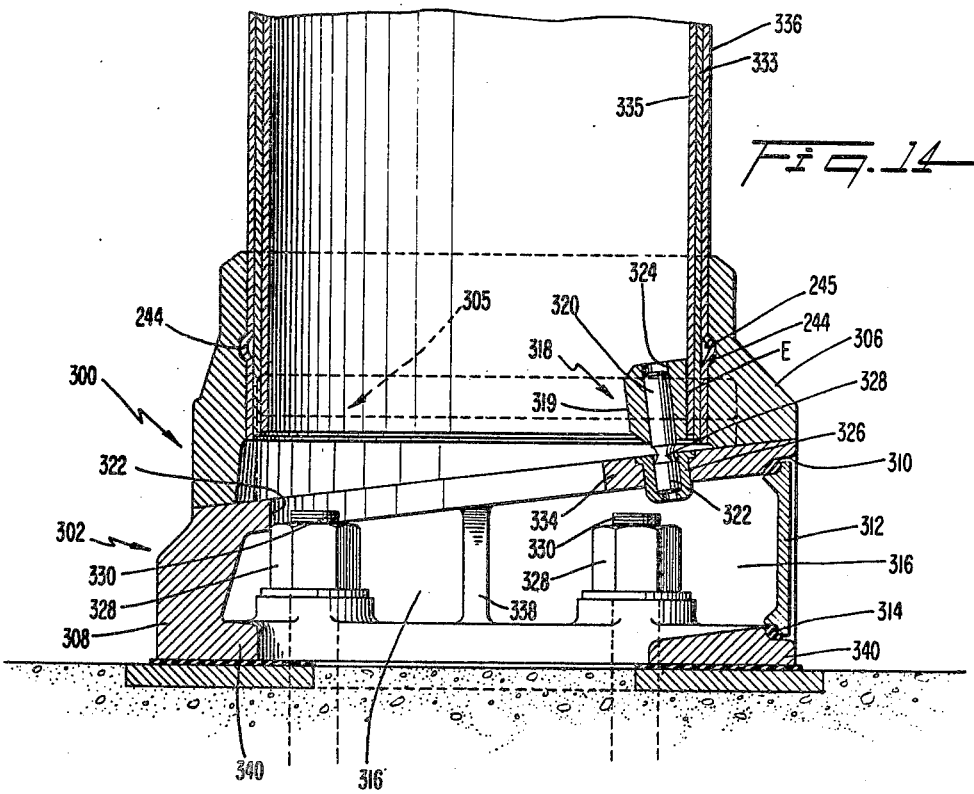
Fig. 14

POLE SUPPORT ASSEMBLY

BACKGROUND OF THE INVENTION

The present invention relates generally to pole supports, and more particularly, towards supports for overhead luminaries having tamper-proof mounting hardware. The invention also relates to pole supports which, in order to minimize bodily injury and property damage, are designed to break-away from the base when struck by a moving vehicle.

Each year, a substantial number of injuries and deaths, as well as property damage are incurred as a result of vehicles colliding with highway signs, traffic signals and overhead lighting. This is because of the strength of the pole itself and the resistance thereof to deformation in response to impact by a vehicle. It has been difficult to manufacture a pole with the requirements that it handle the necessary load for which it is designed, but at the same time, that it yield upon impact by a vehicle. In order to reduce the deleterious results of such impact, frangible supports are often specified that are designed to break-away when struck by a vehicle. The release mechanism for such break-away supports are typically plastic hinges, fracture elements, slip planes or a combination thereof.

Prior art break-away supports are expensive, difficult to install, and are typically unreliable in terms of having a predictable threshold for break-away under impact force. This means that in many instances, the base of prior art supports do not function to prevent the damage and injury they are designed to alleviate. There thus exists a need for highly reliable break-away pole supports that will function to break-away at the proper impact force, but will still resist other outside forces, such as wind loads.

Accordingly, one object of the present invention is to provide a new and improved break-away support for roadway poles.

Another object of the invention is to provide a new and improved break-away pole support that is easy to install and is reusable following impact by a moving vehicle.

Still another object is to provide a new and improved break-away support for roadway poles that requires a minimum number of parts and is reliable in operation.

Supports for roadway poles of which I am aware are typically mounted along a roadway by mounting a base on a poured concrete foundation with embedded anchor bolts. Then the pole is made perfectly vertical using shim stock to take up any irregularities. The base is anchored to the concrete foundation with nuts applied to the threaded bolts that extend through the base flanges on the lower part of the base. Besides detracting from the appearance of the support, the mounting hardware is exposed to possible vandalism. Furthermore, the hardware tends to corrode because of exposure to moisture, as well as collects dirt and debris thereby requiring maintenance. To prevent such conditions, costly covers have been found to be necessary.

Accordingly, another object of the invention is to provide a new and improved roadway pole support wherein mounting hardware is protected from vandalism and environmental moisture.

Another object is to provide a roadway pole support requiring minimum installation and maintenance labor.

The portion of the pole that is most apt to fracture is the lower end thereof at the pole support interface which absorbs stresses induced by external forces, such as wind, applied against the pole. The portion of the pole just above the support is further weakened during assembly as the pole and support are welded together as shown, for example, in U.S. Pat. No. 3,839,835 to Meyer, because welding tends to alter the structure of the metal forming the pole making it brittle. In order to increase the strength of the pole, the wall of the pole must be made relatively thick. The thick wall increases the weight of the pole, makes installation more difficult and drives up costs.

Still another object of the invention, therefore, is to reinforce the strength of the pole in the region of the pole support interface without substantially increasing the thickness of the pole wall.

SUMMARY OF THE INVENTION

A support for roadway tapered poles carrying, for example, overhead lighting, includes a base member containing a compartment for enclosing mounting hardware, and a pole receiving collar formed on the base. The base comprises an upstanding wall, the upper end of the wall forming the collar, and the lower end of the wall forming an inwardly extending foot. The foot of the base is mounted on an annular template embedded in a concrete foundation. The top of the compartment is defined by a reinforced opening in which the pole is mounted within the collar. For reinforcement, a series of vertical ribs are provided inside the base between the collar and the foot. An annular gasket is located between the foot and template to prevent seepage of moisture under the base. The collar and foot each define central apertures formed therein that form passages for routing underground electrical wiring into the pole.

Within the compartment, plurality of threaded rods extend through apertures in the foot and are anchored in the foundation. Nuts are mounted on the rods inside the base compartment and tightened down to secure the base to the foundation.

An opening is formed in the sidewall of the base to permit access to the mounting nuts and wiring during assembly of the support and pole. The opening is enclosed by a removable access door that latches into position relatively easily but requires a special vise-like tool for removal. When installed, the door is flush with the wall of the base member and cannot be removed by unauthorized personnel. One side of the door contains a pair of pins that mount to the rim of the opening for support. The opposite side of the access door contains a spring-biased operator that engages a recess in the rim of the opening to latch the access door closed. The recess also functions as a cam surface that retracts the operator into the access door as the access door is forced by the special tool into the opening beyond the latched position.

Movement of the access door into the opening beyond the latched position is resisted by a plunger inside the access door. The plunger is oriented at a right angle to the operator and abuts a radial flange formed on the rim of the opening.

An axial bore is formed at the end of the plunger opposite the flange. A plug of resilient material is disposed at the bore between the plunger and access door. The diameter of the bore is less than the diameter of the resilient plug, and as the access door is forced into the opening beyond the latched position, the resilient plug ingresses the bore. Thus, the operator is cammed into an unlatched position within the access door and is retained in that position by a spring-loaded retaining member. With the operator unlatched, the access door can be removed but the retaining member must be manually separated from the operator before the access door can be reapplied to the opening.

I am aware of U.S. Pat. Nos. 3,198,296 to Pfaff, Jr. et al and 3,563,502 to Dayson which show pole support bases having sidewall openings closed by an access door. Neither shows, however, a pole support base having a compartment defined by a pole, sidewall and foot, enclosing pole mounting nuts which are accessible only through a sidewall opening. In each patent, the mounting nuts are installed and serviced from outside the base, and are exposed to vandalism and moisture.

In order to reinforce the tapered pole at the support collar, a pair of sleeve members are located inside the pole adjacent the collar. The wall thickness of the pole at the support collar is thus affectively increased without increasing the wall thickness of the remaining length of the pole. The sleeves are preferably a shrink fit in place inside the tapered pole. Similarly, the pole itself may be a shrink fit in the collar of the support member. Optionally, an annular bead may be formed in the wall of the pole after assembly to the collar and/or a layer of epoxy may be applied to increase the holding force between the pole, sleeves and collar.

In a break-away support embodiment of the invention, the pole is mounted in a collar that forms a part of a break-away coupling. The body of the coupling is wedge-shaped in both vertical and horizontal cross sections. The coupling fits in a wedge-shaped seat formed in the top of a stationary support member, the coupling and seat forming a locking angle characterized by corner angles of $\theta$, where $83° < \theta < 90°$. The coupling is assembled to the support member by sliding the wedge into the seat until the wedge and seat are secured together by friction. The force of friction is adequate to retain the pole on the support due to the locking angle construction, but when the pole receives a low blow from a moving vehicle, the wedge body releases from the seat permitting the pole and coupling to separate from the stationary support. Resistance to the vehicle by the pole as the wedge releases is minimal; as a result, there is little damage to the vehicle and pole. Furthermore, since there is a non-destructive separation of the wedge-shaped coupling body from the seat, the entire assembly can be reused.

As stated, friction between the wedge-shaped coupling body and seat is adequate to retain the two units together for release only upon impact by a moving vehicle. However, in order to establish the exact amount of the break-away force required to release the hold between the wedge-shaped body and seat, a shear pin may be located across the body-seat interface. The pin is inclined in relation to the axis of the pole, and the lower end of the pin is seated in a block secured to the stationary support. The upper end of the pin is seated in a block in abutment with the inner surface of one of the pole reinforcement sleeves. The upper block is secured to the surface of the sleeve to prevent the block from becoming dislocated during impact and possibly interfering with separation. During installation, the shear pin is manually mounted in the lower block through the opening formed in the upstanding wall of the stationary support. Then, the upper block is positioned on the exposed part of the pin and secured by epoxy or the like.

The support is installed on-site along the roadway by first digging the foundation hole, securing and leveling the template and rod assembly in place and then pouring the concrete to form the foundation. The annular template containing the threaded rods is thus embedded in the concrete in a perfectly leveled condition upon which is to be mounted the stationary support member. As a result, subsequent truing of the pole using shim stock is generally not required. Following curing of the concrete, the stationary support and pole are mounted on the template with the anchor rods extending up into the compartment through the foot of the support member base. The nuts are brought into the opening formed in the base wall and mounted on the anchor rods inside the compartment. The nuts are tightened down to secure the base to the foundation. After any electrical wiring inside the pole is completed, the opening in the wall of the base is sealed by the access door.

Still other objects and advantages of the present invention will become readily apparent to those skilled in this art from the following detailed description, wherein I have shown and described only the preferred embodiments of the invention, simply by way of illustration of the best modes contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature and not as restrictive.

BRIEF DESCRIPTION OF THE DRAWINGS

FIG. 1 is a top view of one embodiment of the support in accordance with the invention with the pole shown in cross section;

FIG. 1*a* is an overall view of the tapered pole and support;

FIG. 2 is a cross sectional view of the support and pole taken along the line 2—2 in FIG. 1;

FIG. 3 is a cross sectional view of the support and pole taken along the line 3—3 in FIG. 1 showing the removable door;

FIG. 10 is a top view of a detachable coupling similar to the embodiment shown in FIG. 4, including a shear pin provided between the coupling and base;

FIG. 11 is a cross sectional side view of the apparatus in FIG. 10 taken along the line 11—11;

FIG. 12 is a cross sectional side view of the apparatus in FIG. 10 showing a detail of the shear pin taken along the line 12—12;

FIG. 13 is a top view of another embodiment of a detachable coupling and base assembly which is a low profile version of the apparatus shown in FIG. 4;

FIG. 14 is a cross sectional side view of the apparatus taken along the line 14—14 of FIG. 13;

DETAILED DESCRIPTION OF THE PREFERRED EMBODIMENTS

Figure 4:
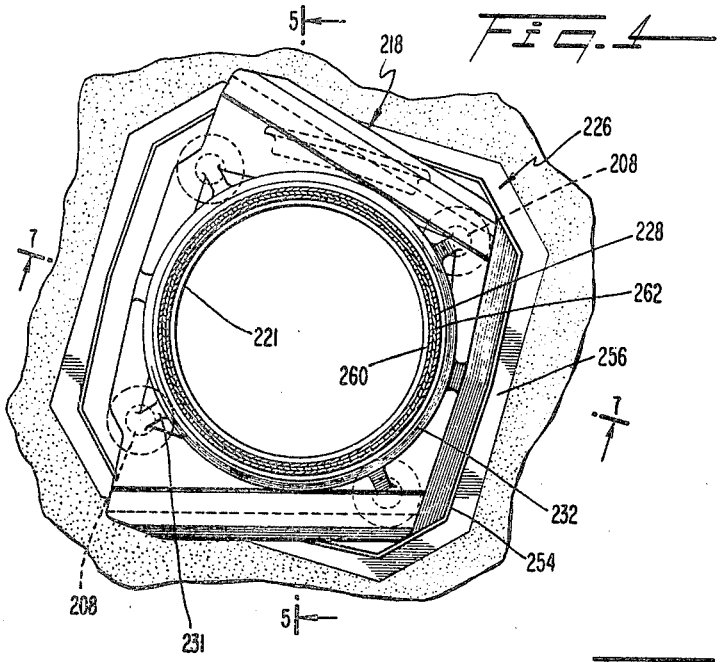
FIG. 4 is a top view of a wedge-shaped coupling for detachably mounting the pole on a stationary base.

Referring to FIGS. 1–3, a support 100 for a tapered pole 102, supporting a roadway luminarie, for example, comprises a hollow base 104 preferably formed of cast metal having an upstanding wall 106 enclosing a compartment 108. At the upper end of the wall 106 is formed a collar 110 tapered to match the taper of the lower end of the pole, and thereby adapted to receive the pole 102, and at the lower end of the wall, there is formed an inwardly directed circumferential foot 112. The collar 110 is mounted on a set of vertical support ribs 116 above compartment 108 and these ribs form support for the wall 106. An additional set of support ribs 118 are formed externally on the collar 110 to resist substantial stresses applied to the collar as a result of outside forces, such as wind, acting on pole 102.

At the bottom of base 104, an aperture 120 is defined by the inner periphery of foot 112. Similarly, there is an aperture 121 defined by the inner wall surface of the collar 110. The foot 112 is supported on an annular template 122 that is embedded in a poured concrete foundation 124. The aperture 120 along with aperture 121 allows for routing of underground electrical wiring through the base 104 and upwardly into the pole 102. A conduit (not shown) may be provided through apertures 120 and 121 as a wiring guide. The compartment 108 is enclosed around the full periphery (see FIGS. 1 and 3).

The base 104 is secured to the foundation 124 with a plurality of conventional anchor rods 126 that extend down into the foundation and hook around at a curved end portion (not shown) for anchoring. The upper ends of the rods 126 are threaded, as shown, and the rods are screwed into template 122. The base 104 is mounted on the template 122 by locating the rods 126 through a series of apertures 128 (FIG. 2) formed in foot 112. The base 104 is secured in place by mounting nuts 130 on the threaded upper portions of the rods, and tightening down the nuts against the foot 112.

In practice, the hole for the concrete foundation 124 is first dug, the template and rod assembly placed and secured in the hole and accurately leveled, and then the concrete is poured to permanently mount the template in a leveled condition. After the concrete has cured, the base 104 and pole 102, which are assembled together prior to installation, are mounted on the rods 126 and secured in place with nuts 130. Since as just described leveling of the template is made before the base and pole are mounted thereon, and since the upper surface of the template is true and level to begin with, it is not necessary to true the pole with shim stock after the installation. The installed pole of FIG. 1*a* is, as a result of this technique, rendered perfectly vertical.

Access to nuts 130 inside compartment 108 is made through an opening 132 (see FIG. 3) formed in wall 106. The opening 132 is sealed by an access door 134 which is normally latched in place, as shown, but requires a special tool 480 (FIG. 18*a*) for removal. The novel access door 134 is described in detail with respect to FIGS. 15–20, and the tool 480 is described with respect to FIG. 18*a*, infra. However, the the door 134 is removed from wall 106 in order to install nuts 130 as well as electrical wiring (not shown) during installation of the base 104 and pole 102, or to perform required maintenance. Because nuts 130 are completely enclosed with compartment 108, the nuts 130 and rods 126 are protected from the deleterious effects of the environment and against possible tampering. The compartment 108 is sealed from moisture by a first gasket 136 disposed between the bottom of foot 112 and the top of template 122, and by an O-ring 138 under the casting 134 as shown in FIGS. 2 and 3, respectively. As described in more detail in connection with FIGS. 15–20, the door 134 forming the access door is flush with wall 106 and cannot be removed unless the special tool 480 (FIG. 18*a*) is used.

In accordance with the present invention, the region of tapered pole 102 adjacent collar 110 is reinforced with two reinforcing sleeves 140 and 142 formed of metal stock having a thickness equal to the thickness of the wall of pole 102. The concentric sleeves 140 and 142 are a tight fit inside the inner wall surface of the pole 102 and extend upwardly from the collar 110 along only a fraction of the height of the pole. In practice, I makes sleeves 140 and 142 respectively twenty-four inches and sixty inches long compared to a pole height of up to forty feet. The sleeves 140 and 142 are secured to the inner surface of pole 102 by any suitable means, such as epoxy or shrink fitting. The pole 102 in turn is secured to the inner surface of collar 110 by the tapering tight fit and epoxy or by shrink fitting. If desired, the connection between the pole 102 and collar 110 can be made more secure by beading the pole from the inside so as to grip the inner surface of the collar 110. As described in detail in connection with FIG. 12 below, this is done during production by forming an annular recess in the collar 110, assembling the pole 102 to the collar, forming the bead in the pole so that it fits within the annular recess, and then applying the reinforcing sleeves 140 and 142.

Of particular importance, as a result of sleeves 140 and 142, the strength of the pole 102 is substantially increased in the region of the collar 110, where it is needed to resist fracture, but the remaining length of the pole is formed as a single layer of stock material. For example, if the pole, as well as sleeves 140 and 142, is formed of 0.090 inch stock, the lower portion of the pole at collar 110 has an effective thickness of 0.270 inch as compared to the remaining portion thickness of 0.090 inch.

Figure 5:
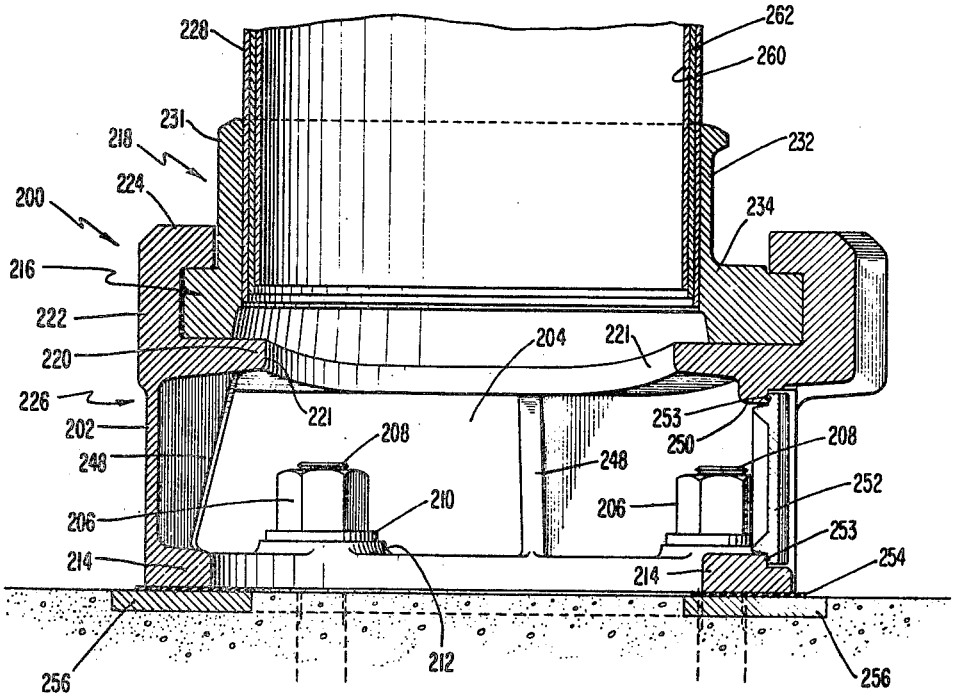
FIG. 5 is a cross sectional view of the detachable couplig taken along the line 5—5 in FIG. 4.

Referring now to FIGS. 4–9, another embodiment of the invention, wherein a pole 228 is mounted in a breakaway coupling is described. Support assembly 200 comprises a stationary support member 226 having an upstanding peripheral wall 202 enclosing a compartment 204 (FIG. 5). Within compartment 204, nuts 206 are threaded onto anchor rods 208 and tightened down against washers 210 and lands 212. The lands 212 are located on an inwardly extending peripheral foot 214 formed on the lower end of the upstanding wall 202. The upper end of wall 202 forms a tapered or wedge-shaped guideway or seat 216 on the stationary support member 226 that slidingly receives a breakaway pole coupling 218. Still referring to FIG. 5, seat 216 includes an inclined plate member 220, and opposite sides of the plate member 220 are formed with vertical sidewalls 222 and upper wrap around retaining flanges 224. As more clearly seen in FIG. 9, although plate member 220 is inclined, flanges 224 are horizontal so that the seat 216 has a wedge-shaped vertical cross section.

Figure 8:
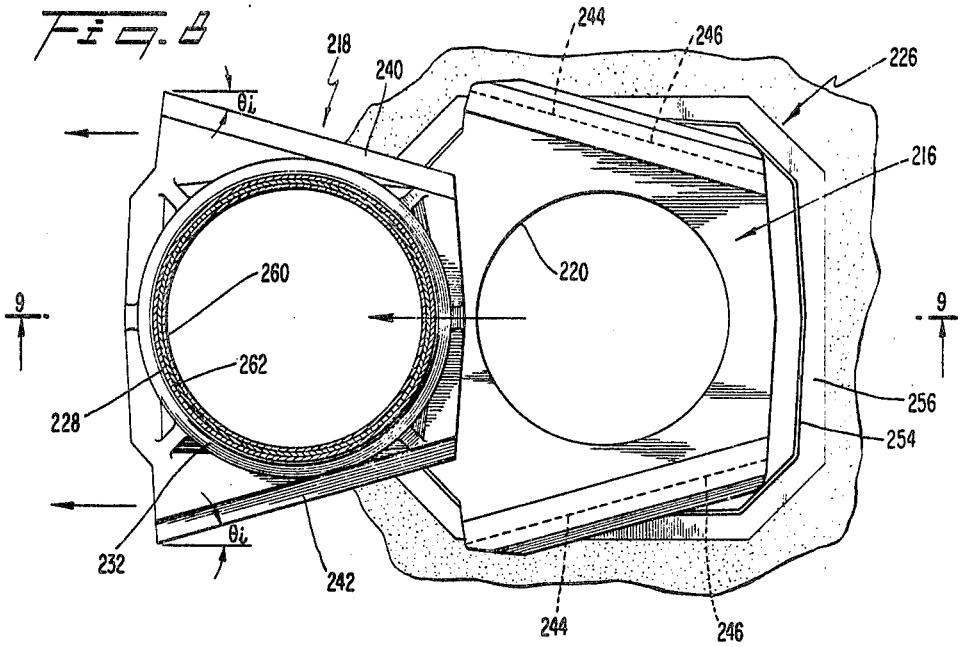
FIG. 8 is a top view of the stationary base and coupling shown in FIG. 4 undergoing decoupling.
Figure 9:
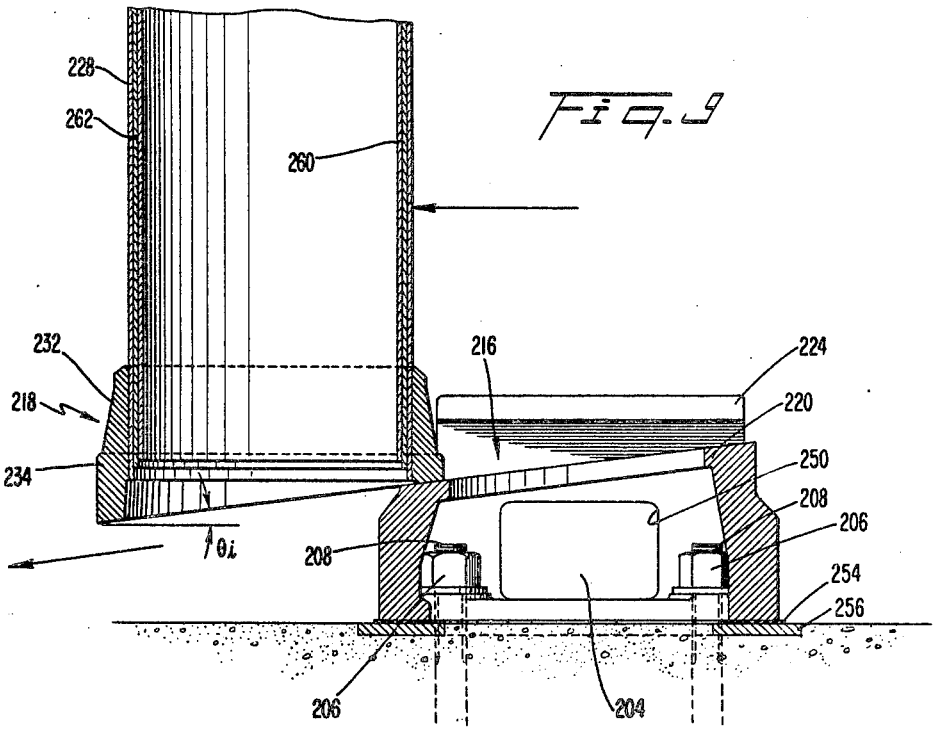
FIG. 9 is a cross sectional side view of the base and coupling taken along the line 9—9 in FIG. 8.
Figure 15:
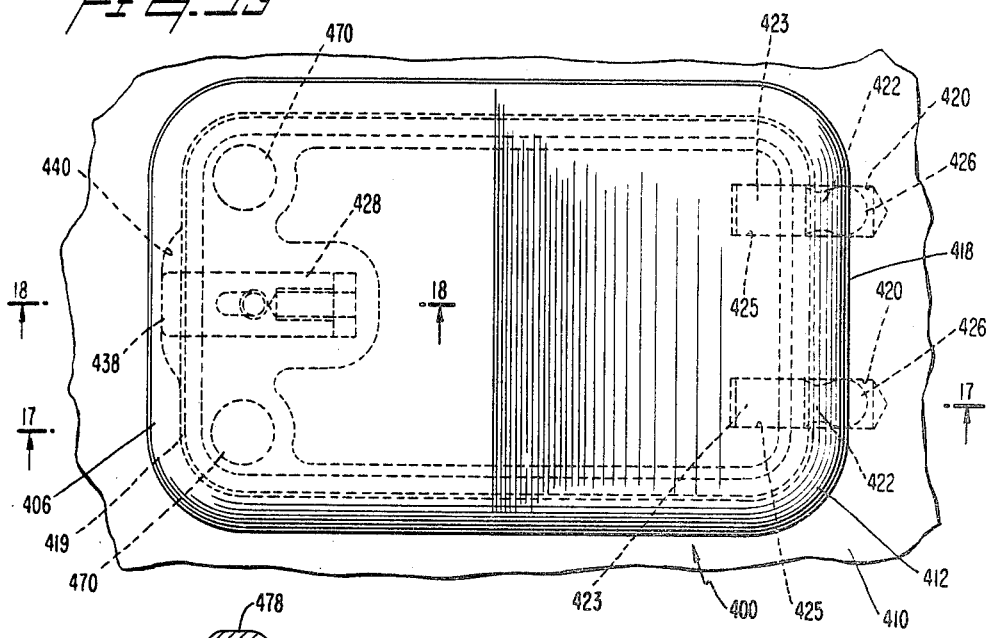
FIG. 15 is a front view of the access door mounted to the wall of a stationary base member.
Figure 16:
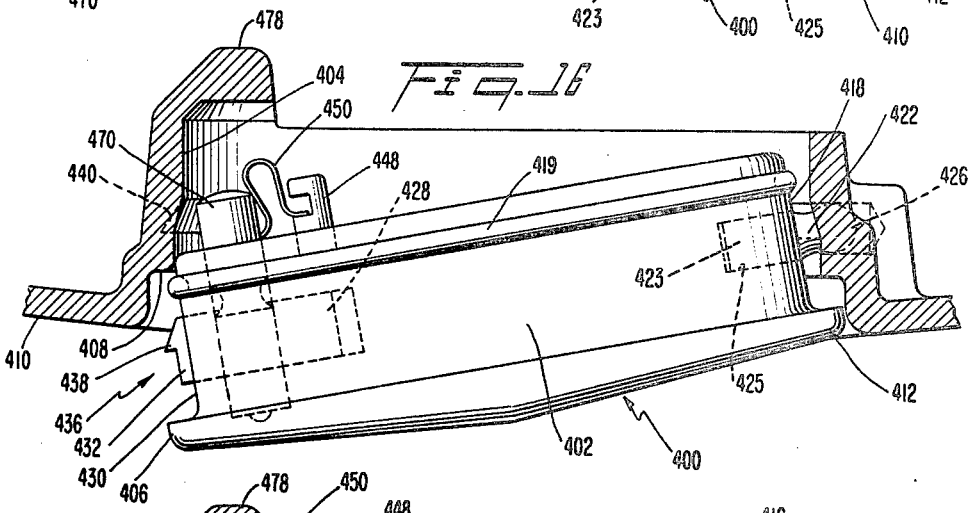
FIG. 16 is a top view of the access door in an open, unlatched position as it is being pivoted into the base wall opening of the stationary support member.

Referring to FIG. 8, the vertical sidewalls 222 of seat 216 are inclined toward each other whereby the seat has a wedge-shaped horizontal cross-section. The seat 216 is adapted to receive body 234 of coupling 218, which as seen in FIGS. 8 and 9, also has wedge-shaped vertical and horizontal cross sections. The body 234 and seat 216 have machined mating surfaces and form a two-plane locking angle interface characterized by corner angles $\theta_{i,j}$ where $83° < \theta_{i,j} < 90°$. When the coupling 218 is positioned in seat 216, the body 234 of the coupling is secured therein by an efficient frictional wedging relationship. The coupling 218 is designed to be separated from seat 216 only in response to a substantial static or impulsive force applied to the coupling through the pole 228, as discussed below.

Coupling 218 comprises an annular collar 232 integrally formed to the wedge-shaped body 234 and adapted to receive hollow pole 228. Pole 228 may be, for example, up to forty feet in length for supporting lighting above a roadway. Collar 232 is reinforced with vertical ribs 231 (FIG. 8) to prevent fracturing thereof as a result of substantial stresses induced thereon by pole 228.

As described above, body 234 of the coupling 218 is tapered corresponding to the wedge-shaped seat 216 so that when coupling 218 is positioned in the seat 216, as best shown in FIG. 5, there is substantial frictional contact at the interface between the machined surfaces of base 234 and the flanges 224, walls 222 and plate 220. With the coupling 218 firmly positioned in seat 216, the wedging action establishes the substantial static friction at the interface. Advantageously, the retaining force is sufficient to resist normal outside forces without the need for fasteners, such as bolts.

During installation of the coupling 218 into seat 216, the coupling body 234 is first located in the seat 216 with the body spaced apart from sidewalls 222 and flanges 224 (cf. FIGS. 8, 9). The coupling 218 then freely slides along the seat 216 toward the narrow end until there is contact between the tapered sides of the coupling base 234 and the inner frictional surfaces of walls 222 and flanges 224. Thereafter, as a result of the wedging induced static friction between contacting surfaces, only a substantial static or impulsive force applied low on pole 228 can displace the coupling 218 from seat 216. However, once the coupling body 234 is separated from the inner surfaces of walls 222 and flanges 224 of seat 216, the coupling easily slides on the seat for separation of the pole 228 and support 200.

Referring to FIGS. 8 and 9, a force applied to coupling 218 in the direction of the arrow imparted by a moving vehicle to the pole 228 releases the coupling 218 from the seat 216 and this separation desirably occurs while imparting minimal damage to the pole and vehicle. Of particular importance, once the machined mating surfaces of the coupling are separated from contact, the coupling easily slides along the seat for release as shown in FIG. 9. Since clearance between the sidewalls of the coupling 218 and seat 216 increases as the coupling traversed the seat, as shown, there is no binding of parts, and there is minimum resistance to the continued movement of the vehicle. As a result, once the initial static friction is overcome, the coupling is fully released, the lower end of the pole is free to kick up in the air and over the vehicle so that there is no penetration of the vehicle by the pole 228. This full release after simply overcoming the static friction of the wedge interface has been found to be a highly efficient energy absorber and substantially minimizes the risk of injury to passengers and damage to the vehicle.

During installation, the stationary support member 226 is oriented adjacent the roadway so as to ensure that an oncoming vehicle will strike the pole in a direction appropriate to cause separation between the coupling 218 and seat 216. The force applied to the coupling 226 tending to cause separation is maximum when the force is applied in the direction of the 0° reference arrow shown in FIG. 8. However, separation between the coupling 218 and seat 216 will also occur in response to vehicle impact applied to pole 228 at an angle falling between ±90° relative to the reference arrow. Separation between the coupling 218 and seat 216 is guided by the tapered sides 240 and 242 of the coupling body 234 (FIG. 8) that slide along respectively tapered guide surfaces 244 and 246 on walls 222 of the seat 216.

The reactive force applied to the vehicle by the pole 228 is minimum when impact occurs in the direction of the reference arrow in FIG. 8, and increases at impact angles displaced from the reference angle. In fact, for impact angles greater than or equal to ±90°, the reactive force is equal to the impact force whereby there is no separation. It is therefore necessary that support 200 be mounted at the roadway so that any on-coming vehicle tends to strike the pole 228 with a range of ±90° relative to the reference arrow (FIG. 8). This is within the desirable 100% probability since even if a vehicle spins around in an accident, the forward momentum still carries the vehicle in the direction of proper traffic flow for which the support assembly 200 is set.

Figure 6:
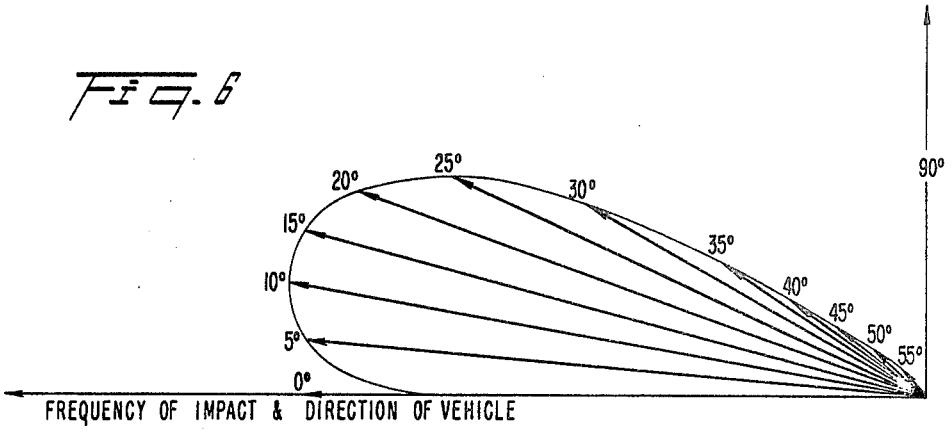
FIG. 6 is a graph illustrating frequency of impact versus direction of vehicle travel in accordance with survey results.
Figure 7:
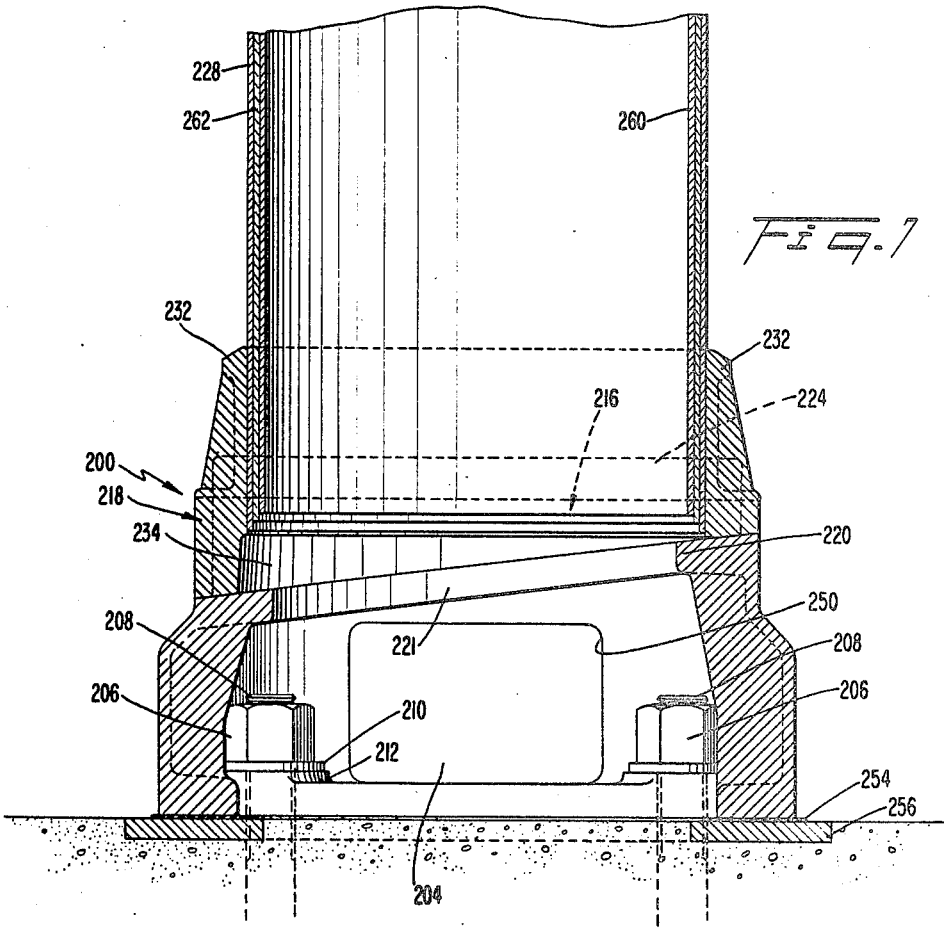
FIG. 7 is a cross sectional side view of the stationary base and coupling along the line 7—7 in FIG. 4.

Referring to FIG. 6, a graph illustrating the frequency of impact of on-coming vehicles as a function of vehicle direction in the range of 0°–90° determined by survey testing is shown. As is apparent from the graph, the frequency of impact is maximum between impact angles of 5° and 20°, where 0° is the reference angle oriented in the direction of the roadway traffic flow. The frequency of impact drops off substantially beyond an angle of 25° from the roadway, and rapidly approaches zero as the angle of impact approaches 90°. It can thus be appreciated that by positioning the support assembly 200 with the reference angle 15° to the longitudinal axis of the roadway, the detachment of the pole 228 will be effected most efficiently and as a result of impact from any on-coming vehicle traveling the roadway.

Referring again to FIG. 5, the full weight of the pole 228 and coupling 218 is supported on the inclined plate 220. The plate 220 is reinforced by a series of vertical ribs 248 extending between the plate and the foot 214. The plate 220 has a central opening 221 to permit routing of electrical underground wiring (not shown) through compartment 204 up into the pole 228. Access to the compartment 204 for installing and maintaining nuts 206 and electrical wiring is made through opening 250 formed in compartment wall 202. The opening 250 is closed by door 252 corresponding to door 134 in FIG. 3 that is latched in position by means described in connection with FIGS. 15–20, and which can be unlatched only with a special tool 480, shown in FIG. 18*a*. The compartment 204 is sealed from moisture by O-ring 253 on the door 252 as well as by gaskets 254 positioned between foot 214 and mounting template 256. The mounting template 256 corresponds to the template 122 in FIG. 2, and is embedded in concrete foundation 258. The template 256 is leveled during installation before the concrete cures to ensure that the pole 228 stands perfectly vertical.

As aforementioned, maximum stress is applied to pole 228 at the lower region thereof adjacent collar 232. In order to reinforce pole 228, a pair of reinforcement sleeves 260 and 262 are located along the lower inner surface of the pole. Sleeves 260 and 262 correspond to sleeves 140 and 142 shown in FIG. 3. The sleeves 260 and 262 are preferably secured in place inside the pole 228 by shrink fitting, and may be reinforced with epoxy, if desired. The sleeves 260 and 262 extend upwardly along only a portion of the pole 228 so that the amount of stock material used is minimized and the strength of the pole is increased only in the region where it is needed. In practice, the sleeves 260 and 262 as well as the pole 228 are formed of 0.090 inch aluminum. Sleeve 260 is 24 inches in length and sleeve 262 is 60 inches in length. The height of the pole 228 may be 40 feet or more. These parameters are variable.

As aforementioned, static friction between the coupling 218 and coupling seat 216 is adequate to secure the coupling and seat together in the absence of impact by a moving vehicle. Forces imparted to the pole 228 by wing tend to cause the pole to pivot about its base. There is no sliding of coupling 218 on the seat 216 in the absence of a substantially horizontal force applied low on the pole. Wind characteristically does not supply a horizontal static force or horizontal impulsive force at the lower end of the pole 226 sufficient to release the coupling 218 from seat 216. In order to more exactly establish the threshold amount of mechanical coupling or hold between the pole coupling 218 and seat 216, a shear pin of selected strength may be positioned between the coupling and seat. The shear pin, in effect, establishes a measured amount of the "change in momentum" value limit for the break-away feature. For the first time, the exact limit that may be propagated by governmental authorities can be matched by the pole manufacturer. The deficiencies of the prior art due to uncertainties in the base castings, i.e., unevenness, differences in metal melts and other hard to control parameters, are obviated.

Referring to FIGS. 10–12, an embodiment of the invention is shown wherein a shear pin 264 extends between coupling 218 and stationary support member 226. Pin 264 comprises an upper body member 268 and a lower body member 266 joined together at an annular shear portion 270. The shear pin 264 is inclined relative to the longitudinal axis of pole 228, and is seated in a lower block 272 and in an upper block 274. The lower block 272 is located within the stationary support member 226. The upper body member 268 of shear pin 264 is located in block 274 with shear portion 270 positioned at the interface between coupling 218 and support member 200. The upper block 274 is in abutment with inner reinforcement sleeve 260 so that the shear pin 264 which extends between coupling 218 and seat 216 retains the coupling in position on the seat.

During installation, after the coupling 218 and pole 228 are mounted in position on seat 216, the shear pin 264 is dropped into bore 278 inside lower block 272 and upper block 274 is slipped over the body member 268 of the pin and lowered until the block wedges against the inner surface of reinforcement sleeve 260. Preferably, the upper block 274 is secured by epoxy E to sleeve 260 as shown so that the block is retained within the coupling 216 following separation. Installation of the shear pin 264 is made through opening 250 in base wall 202. If upper block 274 has been previously secured in position (this would occur during reassembly following a separation caused by vehicle impact), the shear pin 264 may be installed by manually dropping the pin through bores 276 and 278. The depth of bore 278 in lower block 272 is such that the shear pin 264 is automatically positioned with shear portion 270 located at the coupling-seat interface. Since the bores 276 and 278 in the upper and lower blocks 274, 272 may not line up to each other during assembly on-site, it is preferable to remove the upper block 274 from sleeve 260 prior to assembly.

As aforementioned, the pole 228 is secured to collar 232 by shrink fitting or epoxy. However, in order to further increase the amount of coupling between the pole 228 and collar 232, a crimp or bead 244 may be formed on the surface of the pole for increased contact with the collar 232, as shown in FIGS. 11 and 12. The bead is formed in pole 228 during assembly of the pole to coupling 218 at the factory by forming annular recess 245 in the collar 232, assembling the pole to the collar, using a conventional bead forming tool inside the pole to form the bead, and then shrink fitting sleeves 260 and 262 inside the pole.

With the advent of compact and subcompact automobiles having low wheel bases, low profile supports for highway signs, luminaires and the like are often specified to avoid contact by the axles during collision. Referring now to FIGS. 13 and 14, a low profile version 300 of the break-away pole support 200 provides support for pole 336 reinforced by sleeves 333 and 335 in accordance with the invention. Support assembly 300 comprises a stationary support member 302 having a coupling seat 304 (FIG. 13) for receiving pole 336 and pole coupling 306 above a compartment 316 containing mounting hardware including nuts 328 that are mounted on anchor rods 330 as well as any electrical wiring (not shown). Coupling 306 is mounted in seat 304 which comprises a pair of C-shaped guideways 305 formed on opposite sides of inclined plate 334 defining a wedge-shaped seat. Coupling 306 is identical to coupling 218 shown in FIG. 5. Stationary base 302 corresponds to base 216 in FIG. 5 but has a lower profile than base 216 and comprises an upstanding wall 308, one side of which contains an opening 310 enclosed by a door 312. An O-ring seal 314 is located between the door 312 and wall 302 to prevent leakage of moisture into compartment 316 enclosed by the wall. The upper end of wall 308 is formed with inclined plate 334 functioning as the coupling seat and the lower end of the wall is formed with foot 340.

A shear pin 318 is located between coupling 306 and stationary support member 302. The shear pin 318 has an upper body member 320 corresponding to body member 268 shown in FIGS. 7 and 12, and a lower body member 322 which is shorter than body member 266 in those Figures. Body member 320 is positioned within bore 324 of upper block 319 secured to the inner surface of pole reinforcing sleeve 333, and body member 322 is seated in lower block 326. The lower block 326 is relatively short to accomodate the short body member 322 of pin 318 and extends downwardly into compartment 316, as shown. The upper body member 320 and lower body member 322 are joined together at shear portion 328 located at the interface between coupling 306 and stationary support member 302.

Although stationary support member 302 is relatively short (compare with support 226 in FIG. 7), it is apparent that there is adequate room in compartment 316 for mounting the nuts 328 on threaded rods 330 and tightening down the nuts, as required. An aperture 332 is formed in inclined plate 334; this aperture provides additional clearance for one of the nuts 328, as shown in FIG. 14, and permits routing of underground wiring through the break-away support into pole 336. Vertical support ribs 338 extending between foot 340 and plate 334 provide reinforcement to the stationary base 302.

Figure 17:
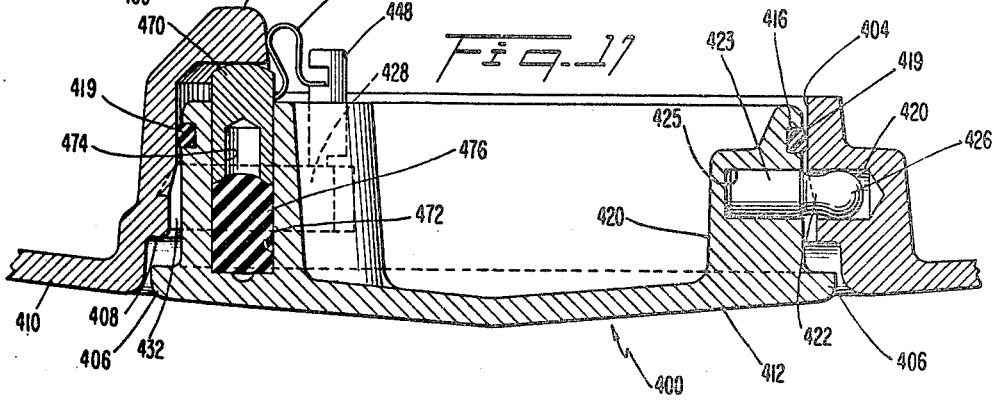
FIG. 17 is a cross-sectional top view of the casting forming the door in a latched position.

Referring now to FIGS. 15–20, a door in accordance with the invention for sealing the sidewall opening accessing the compartments in the stationary pole support assembly (FIGS. 1–3) and break-away pole support assembly (FIGS. 4–14) will now be described in detail. The door is identified generally by 400, and is illustrated in cooperation with an opening 404 formed in wall 410. It is to be understood that these support components and the door correspond to similar elements shown in the preceding figures. Access door 400 comprises a body 402 having a rectangular configuration corresponding to opening 404 and formed with an annular lip 406. The annular lip 406 extends into a recess 408 formed in wall 410 when the door 400 is latched in place in the opening (FIG. 17). As shown, the outer surface 412 of door 400 is flush with support wall 410 when door 400 is mounted and latched in opening 404.

An O-ring 419 is seated in an annular groove 416 formed on the body 402. The wall of opening 404 is slightly tapered so that the O-ring 419 forms a tight seal with the opening wall when the door 400 is seated therein.

One side 418 of the door 400 has formed therein a pair of bores 425 (FIG. 7) for receiving mounting pins 422. One end 423 of each of the pins 422 is cylindrical for seating within bore 420; the pins may be secured therein using epoxy. The opposite end 426 of each of the pins 422 is ball-shaped and adapted to be seated within another bore 420 formed in the wall of opening 404. Pin 422 is not secured within the bore 420 so that the casting 400 can be pivoted about the ball shaped end portion 426 of the pin 422 and then completely removed from the opening.

A latching mechanism, indicated generally as 428, is provided in the door 400 at the side 430 thereof opposite side 418. Mechanism 428 comprises an operator 432 slidably mounted in an operator seat 434 formed in the door 400. The exposed outer end 436 of the operator 432 contains a tapered portion 438 that is adapted to engage a recess 440 formed in the wall of opening 404. A spring 442 (FIGS. 18 and 19) is located within a spring seat 444 inside the operator 432 extending to seat wall 446, and biases the operator against the wall opening 404.

Figure 18:
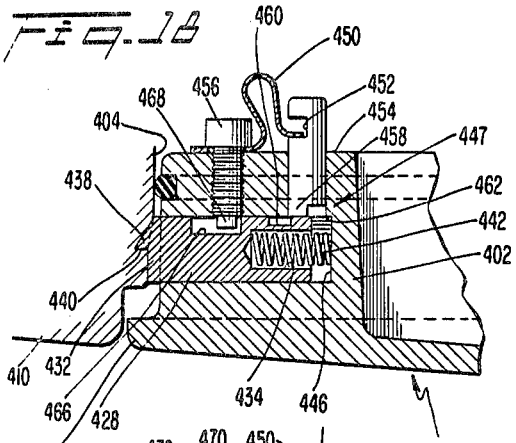
FIG. 18 is a partial view of the door showing a detail of the latching assembly.

An operator retainer 448 extends through the door 400 perpendicular to the operator 432 and is biased in the direction of the operator by leaf spring 450. One end of leaf spring 450 is located in slot 452 formed in retainer 448 and the opposite end of the spring is secured to the backside 454 of the door 400 by bolt 456 (FIG. 18).

Figure 19:
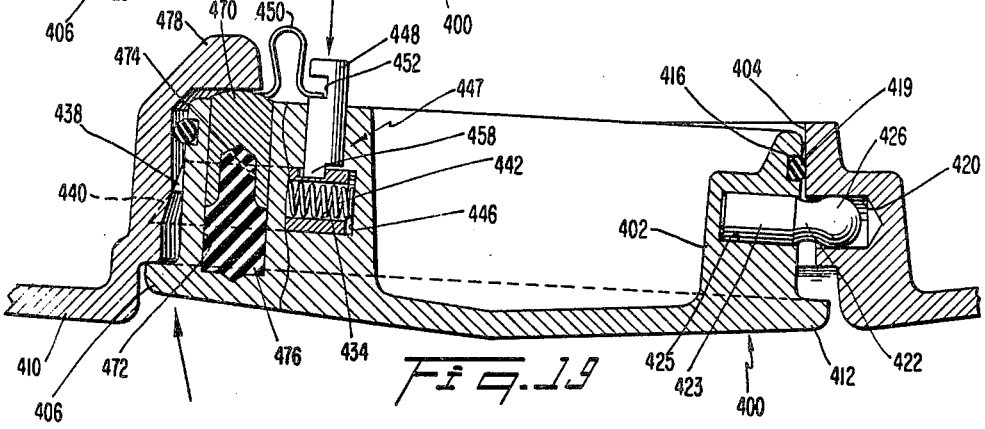
FIG. 19 is a cross-sectional top view of the door as it is being urged into the base wall opening for unlatching.
Figure 20:
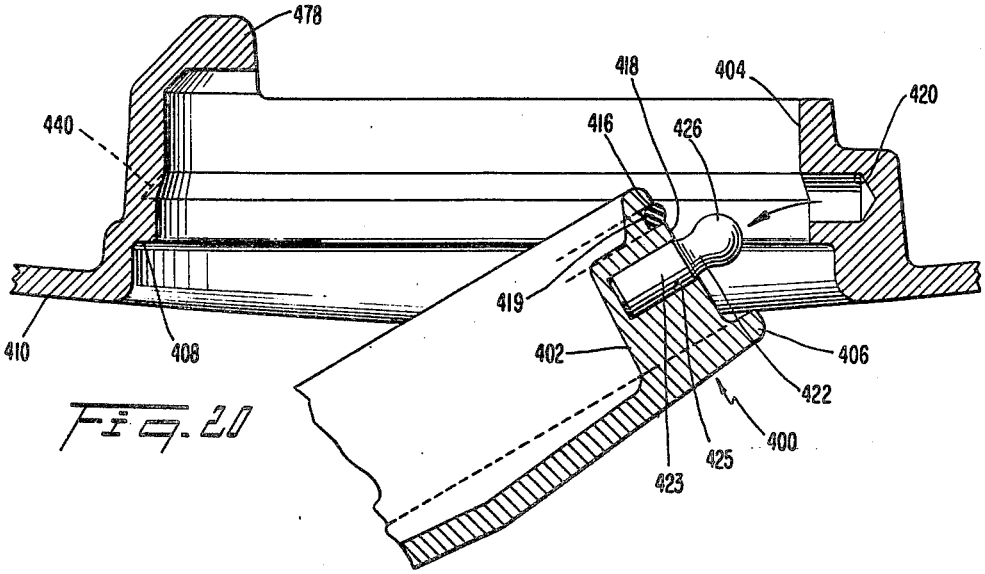
FIG. 20 is a partial cross-sectional top view of the door as it is being removed from the base wall opening.

At the operative end 447 of retainer 448, a tab 458 extends downwardly toward operator 432, and is adapted to fit within a recess 460 formed in the wall of the operator. When the operator is in a latched position, as shown in FIG. 18, tab 458 of the retainer 448 sits on land 462 of the operator. In this position, retainer 448 provides no resistance to movement of the operator 432 within operator seat 434 from a latched position (FIG. 18) to an unlatched position (FIG. 19). When the operator 432 is in the unlatched position, leaf spring 450 forces retainer 448 downwardly so that tab 458 interfits with recess 460 retaining the operator unlatched, as shown in FIG. 19. An elongated recess 466 in the sidewall of the operator 432 provides clearance for guide tip 468 of the bolt 456 during movement of the operator within operator seat 464.

Tip 438 of the operator 432 is wedge-shaped and forms a cam surface in cooperation with recess 440 in the wall of opening 404 whereby the operator is urged into door 400 as the door is pivoted into the opening beyond the latched position (FIG. 18), as shown in FIG. 19. Movement of the door 400 into opening 404 beyond the latched position is resisted by a plunger 470 described in detail below. As operator 432 is moved into the door 400, tip 438 of the operator becomes decoupled from recess 440. With operator 432 retained inside door 400 by retainer 448, the door is unlatched for removal. The door 400 is removed from opening 404 by pivoting the left-hand side of the door outwardly from the opening and pulling the door from the bores 420 on the right-hand side (see FIG. 20).

In order to prevent access to the interior of the pole support by unauthorized personnel, the door 400 is designed to be quite difficult to unlatch. Referring to FIG. 17, plunger 470 is slidably mounted within a bore 472 formed in the door 400 perpendicular to operator 432. One end of the plunger 470 within bore 472 contains an axial bore 474, and the opposite end thereof abuts plunger seat 478 formed on the wall of opening 404. Disposed within the bore 472 adjacent axial bore 474 is a plug of resilient material, such as rubber. The plug 476 completely fills the diameter of bore 472 and is larger in diameter than the diameter of plunger bore 474. The plug 476 tends ti bias the plunger 470 outwardly against plunger seat 478. The plunger 470 is maintained in contact with seat 478 when the door 40 is located in the latched position, as shown in FIG. 17. If desired, a steel spring (not shown) can be positioned against plunger 470 inside bore 472 in place of plug 476 for supplying biasing force against the plunger 470.

As an external force is applied to the door at side 430 thereof, as shown in FIG. 19, plunger 470 is urged into the flexible plug 476 with a force sufficient to cause the plug to ingress the plunger bore 474. This permits the door 400 to pivot into the opening 404 so as to index the operator 432 into door 400 for unlatching by camming action between operator tip 438 and wedge-shaped recess 440.

Figure 18A:
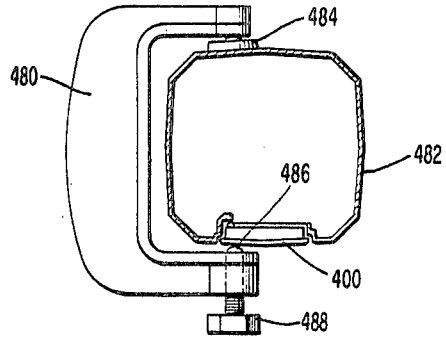
FIG. 18*a* is a schematic view of a tool suitable for unlatching the door.

A substantial force applied to the axis of plunger 470 is required in order to cause the resilient plug 476 to ingress the plunger bore 474. A special, vise-like tool 480 (FIG. 18*a*) is required to apply sufficient force to the door 400 for unlatching. As shown in FIG. 18*a*, vise-like tool 480 spans the support assembly 482 with one end 484 of the tool being in contact with a portion of the support assembly opposite the door 400. Jack screw end 486 of the tool rests on the outside surface 412 of the door over plunger 470. Force is applied to the door 400 by manually rotating the jack screw 488. It is only necessary to pivot the door 400 into the opening 404 a very short distance to cause the resilient plug 476 to ingress the bore 474 in plunger 470, but it is nearly impossible to apply a force of the magnitude required to the door 400 without the tool 480.

Referring to FIG. 17, it is apparent that the exposed surface 412 of door 400 is flush with wall 410 of the support when the door is in a latched position. Accordingly, it is not possible to force door 400 from opening 404 by prying or lifting it out since there are no gripping surfaces on the door and no access points for a prying tool. Access to the interior of the pole support cannot be made without the tool 480. The interior compartment of the pole support assembly containing the mounting hardware and electrical wiring is thereby protected against entry by unauthorized personnel.

In this disclosure there is shown and described only the preferred embodiments of the invention, but, as aforementioned, it is to be understood that the invention is capable of use in various other combinations and environments and is capable of changes and modifications within the scope of the inventive concept as expressed herein.

What is claimed is:

1. A frangible support assembly for vertically supporting a pole on a foundation, comprising:

a base member secured to said foundation;

a collar member secured to said pole; and a wedge-shaped coupling secured to said collar member and adapted to be detachably coupled to said base member, said base member having a wedge-shaped seat for receiving said coupling;

said coupling being retained in said seat by friction and being detachable therefrom on impact by a moving vehicle.

2. The support assembly of claim 1, wherein vertical and horizontal cross sections of said coupling are wedge-shaped.

3. The support assembly of claim 2, wherein said coupling is formed as a locking angle interface with said seat.

4. The support assembly of claim 1, including shear pin means for releasably securing said coupling to said seat.

5. The support assembly of claim 4, wherein said shear pin means includes a lower portion extending into said base member, and an upper portion extending into said coupling, a frangible portion of said shear pin being located at an interface between said base member and said coupling.

6. The support assembly of claim 5, wherein said shear pin is inclined to a pole axis, and said upper and lower portions of said pin are disposed respectively in upper and lower mounting blocks.

7. The support assembly fo claim 6, wherein said upper block is wedge-shaped and located in abutment to said pole.

8. The support assembly of claim 7, wherein said upper block is secured to said pole.

9. The support assembly of claim 1, including reinforcement sleeve means located between said collar member and said pole.

10. The support assembly of claim 9, wherein said sleeve means includes first and second sleeves having a shrink fit within said collar member.

11. In combination:

a hollow pole having an inner wall surface; a support assembly for vertically supporting said pole, said assembly having a foot adapted to be secured to a foundation and an external collar portion adapted to receive said pole; reinforcing sleeve member means disposed on said inner wall surface of said pole adjacent but separate from said collar portion of the support assembly, a length of said sleeve member means be substantially less than a length of said pole, said length of said sleeve member means being limited to the region of high stress adjacent said collar portion and effective to resist fracture from outside forces;

said pole contains an annular bead for securement of said pole to said collar portion.

12. The support assembly of claim 1, wherein said base member includes an upstanding wall, a lower end of said wall having an inwardly extending foot, and an upper end of said wall supporting a plate, said plate forming a support surface of said seat, said upstanding wall and said plate defining a compartment.

13. The support assembly of claim 12, wherein said plate contains an aperture for electrical wiring extending between said compartment and said pole.

14. The support assembly to claim 13, including an opening formed in the wall of said base member for permitting access to said compartment.

15. The support assembly of claim 12, including anchor means for securing said base member to said foundation, said anchor means located in said compartment and extending through said foot, embedded in said foundation.

16. The support assmebly of claim 15, wherein said anchor means includes a plurality of threaded rods, and nut means attached to said rods inside said compartment.

17. The support assembly of claim 14, including an access door detachably mounted to said wall for sealing said opening.

18. The support assembly of claim 17, including latch means for latching said door to said wall.

19. The support assembly of claim 18, including gasket means for sealing said door to said wall.

20. The support assembly of claim 17, wherein one side of said door contains pin means for mounting to said wall, and an opposite side of said door contains a latch for latching said door to said wall over said opening.

21. The support assembly of claim 20, wherein said latch means includes an operator for engaging a sidewall of said base member at said opening as said door is seated into said opening, said operator including cam means for disengaging said operator from said sidewall as said door is urged into said opening beyond a predetermined fixed location.

22. The support assembly of claim 21, including plunger means for biasing said door out of said opening as said door is urged beyond said fixed location for disengagement, a substantial force normal to said door in the direction of said opening being thereby required to disengage said enclosure.

23. The support assembly of claim 21, wherein one end of said plunger facing said door contains an axial bore, and a resilient plug is disposed between said one end of said plunger and said door, said plug having a diameter greater than a diameter of said bore, said substantial normal force applied to said door causing said resilient plug to ingress said bore as said door is seated into said opening.

24. The support assembly of claim 21, including retaining means for retaining said operator in an unlatched position following disengagement of said enclosure from said opening.

25. In a support assembly for vertically supporting a pole on a foundation, said support assembly having a hollow base defining a compartment containing means for securing said base to the foundation, an opening being formed in said base for providing access to said compartment:

door latchable to said base at a fixed position in said opening;

one side of said door having means for supporting said door to said base;

an opposite side of said door containing an operator for latching to a receiving member formed in said base, said operator being spring biased into contact with said receiving member; said receiving member forming a camming surface for said operator so as to urge said operator into said door as said door is forced into said opening beyond said fixed position; and a resilient member disposed between said door and said base, said resilient means being compressed as said door is urged into said opening beyond said fixed position.

26. The apparatus of claim 25, including:

means for retaining said operator within said door, said retaining means being operative to unlatch said door as said door is moved into said opening beyond said fixed position.

27. The apparatus of claim 25, including:

a plunger seated in said door member, said plunger abutting a flange formed on said base adjacent said opening, an end of said plunger within said door having an axial bore; and said resilient member having a diameter greater than a diameter of said bore and positioned between said plunger and said door, said resilient member ingressing said bore as said door member is urged into said opening beyond said fixed position.

28. The apparatus of claim 25, wherein said supporting means includes pin means adapted to fit into bore means formed in said base at said opening, said pin means being removable from said bore means so as to completely remove said door from said opening when said operator is unlatched.

29. The apparatus of claim 25, including seal means disposed between said door member and a wall of said base at said opening.

30. The apparatus of claim 29, wherein said seal means is an O-ring.

31. The apparatus of claim 29, wherein the wall of said base is tapered to improve sealing between said wall and said O-ring.

32. The apparatus of claim 25, wherein said door is flush with an outer surface of said base.

33. A support assembly for vertically supporting a pole, comprising:

an upstanding wall, a lower end of said wall having an inwardly extending foot, an upper end of said wall adapted to receive said pole;

said wall defining a compartment;

holddown means located inside said compartment, said holddown means securing said foot to a foundation;

an opening formed on said wall for providing access to said compartment;

coupling means for detachably coupling said pole, said coupling member being mounted in a seat and being detachable from said seat upon impact by a moving vehicle;

said coupling member including a wedge-shaped portion, said seat having a corresponding wedge shape, said coupling member being retained in said seat by friction.

34. The support assembly of claim 33, wherein said wedge-shaped portion has a locking angle inteface with said seat.

35. The support assembly of claim 33, wherein is provided apertures for electrical wiring extending between said compartment and said pole.

36. The support assembly of claim 33, including shear pin means for releasably securing the wedge-shaped portion of said coupling member to said seat.

* * * * *